US009718163B1

(12) United States Patent
Sun

(10) Patent No.: US 9,718,163 B1
(45) Date of Patent: Aug. 1, 2017

(54) ERASER WHEEL ASSEMBLY STRUCTURE

(71) Applicant: STORM PNEUMATIC TOOL CO., LTD., Taichung (TW)

(72) Inventor: Yung Yung Sun, Taichung (TW)

(73) Assignee: Storm Pneumatic Tool Co., Ltd., Taichung (TW)

( * ) Notice: Subject to any disclaimer, the term of this patent is extended or adjusted under 35 U.S.C. 154(b) by 71 days.

(21) Appl. No.: 15/007,405

(22) Filed: Jan. 27, 2016

(51) Int. Cl.
*B24B 23/00* (2006.01)
*B24B 23/02* (2006.01)

(52) U.S. Cl.
CPC ..... *B24B 23/02* (2013.01)

(58) Field of Classification Search
CPC ..... B24B 23/02; B24B 23/026; B24B 23/028; B24B 45/006; B24B 55/102
USPC ..... 451/359, 548–551, 526–533
See application file for complete search history.

(56) References Cited

U.S. PATENT DOCUMENTS 1,348,050 A * 7/1920 Putnam ..... B24D 7/02 451/551
1,404,139 A * 1/1922 Philbrick ..... B24D 7/06 451/551
1,487,871 A * 3/1924 McGovern ..... B24D 7/06 451/551
6,110,027 A * 8/2000 Muller ..... B24B 55/052 451/342
6,110,028 A * 8/2000 Chung ..... B24B 23/02 451/359
6,203,415 B1 * 3/2001 Torrance-Castanza ..... B24B 23/026 173/DIG. 1
6,277,012 B1 * 8/2001 Halliley ..... B24B 45/00 451/359
6,299,522 B1 * 10/2001 Lee ..... B24B 55/102 451/488
6,332,836 B1 * 12/2001 Tseng ..... B24B 23/022 451/359
7,033,262 B2 * 4/2006 Takizawa ..... B24D 9/085 451/359
7,144,315 B1 * 12/2006 Sun ..... B24D 5/16 451/359
7,217,177 B2 * 5/2007 Frech ..... B24B 23/04 451/357
8,007,347 B1 * 8/2011 Lampka ..... B24B 23/02 451/358

(Continued)

FOREIGN PATENT DOCUMENTS

WO WO 2010071618 A1 * 6/2010 ..... B24B 23/02

*Primary Examiner* — George Nguyen
(74) *Attorney, Agent, or Firm* — Rosenberg, Klein & Lee

(57) ABSTRACT

The present disclosure illustrates an eraser wheel assembly structure in which an eraser wheel body is fastened with a shell cover by a fastener, so the eraser wheel body can be driven by the grinding tool to rotate for removing glue. The eraser wheel body is disposed in the shell cover and has a plurality of glue removing blocks. The shell cover has a plurality of positioning studs and configured to respectively insert positioning holes of the eraser wheel body. The shell cover has a blocking wall facing a peripheral edge of the disc-based base and a gap to tolerate a radial extension of the disc-shaped base during operation, so as to prevent the peripheral edge of the disc-shaped base from being escaped from the blocking wall and unable back to its former position because of no gap tolerable for the radial extension of deformed disc-shaped base.

3 Claims, 8 Drawing Sheets

(56) References Cited

U.S. PATENT DOCUMENTS

| | | | | |
|---|---|---|---|---|
| 8,029,340 | B2 * | 10/2011 | Henning | B24B 23/02 451/359 |
| 8,272,924 | B2 * | 9/2012 | Van Eijden | B24D 7/066 451/353 |
| 8,393,941 | B2 * | 3/2013 | Ghinelli | B24D 3/001 451/526 |
| 8,430,725 | B2 * | 4/2013 | Pajovic | B24B 23/028 451/508 |
| 2002/0182992 | A1 * | 12/2002 | Ueno | B24B 23/02 451/359 |
| 2005/0250429 | A1 * | 11/2005 | Nomoto | B24B 9/06 451/359 |
| 2006/0057948 | A1 * | 3/2006 | Lin | B24B 23/026 451/359 |
| 2008/0003929 | A1 * | 1/2008 | Degen | B23D 47/005 451/359 |
| 2008/0014844 | A1 * | 1/2008 | Pontieri | B24B 23/022 451/359 |
| 2009/0053982 | A1 * | 2/2009 | Popov | B24B 7/186 451/527 |
| 2010/0151775 | A1 * | 6/2010 | Lampka | B24B 23/022 451/357 |

* cited by examiner

ERASER WHEEL ASSEMBLY STRUCTURE

BACKGROUND OF THE INVENTION

1. Field of the Invention

The present disclosure relates to an eraser device, more particularly to an eraser wheel assembly structure.

2. Description of the Related Art

Please refer to FIGS. 6 and 7 which show an eraser wheel 91 and a shell cover 92 adapted to fasten the eraser wheel 91 in conventional technology. The eraser wheel 91 can be driven to rotate by a grinding tool (not shown in FIGS. 6 and 7), to grind and remove an adhesive coating layer, such as paint. The eraser wheel 91 has a plurality of glue removing blocks 911 disposed on a surface thereof and arranged in interval. The plurality of glue removing blocks 911 have the same shape and each is in a straight shape which has a width enlarged from inside to outside. The plurality of glue removing blocks 911 are arranged radially and annularly. The eraser wheel 91 has a plurality of protruding pins 912 disposed on other side thereof. Each protruding pin 912 has a wider blocking part 913 at a top thereof. The shell cover 92 has a groove part 921 formed on a side thereof, and an annular wall 922 formed at a peripheral edge of the groove part 921 thereof. A plurality of through-holes 923 are formed on the groove part 921 inside the annular wall 922.

The eraser wheel 91 is assembled into the groove part 921 of the shell cover 92 by placing the side on which the protruding pins 912 are disposed, and inserting the protruding pins 912 through the through holes 923 and making the blocking parts 913 be blocked at step parts 924. After assembly, the peripheral edge 914 of the eraser wheel 91 is tightly attached with the inner surface 925 of the annular wall 922, the eraser wheel 91 can be driven to rotate by the plurality of protruding pins 912 inserted in the through-holes 923 during rotation of the shell cover 92 driven by the grinding tool, so as to grind and remove the glue.

The eraser wheel 91 is made from flexible material and has a hardness falling within a score range of 50 to 60 in Shore hardness Type A for facilitating to remove the glue, However, while the eraser wheel 91 is being rotated to remove glue, the part of the eraser wheel 91 tightly attached with the position being removed glue is pressed and deformed to be flatter in an axial direction and wider in a radial direction. Particularly, as shown in FIG. 7, while removing glue at a rough place, the peripheral edge 914 of the eraser wheel 91 is easily squeezed out of the annular wall 922 because of aforesaid deformation, so that the eraser wheel 91 is axially moved out of the shell cover 92 and it further causes the blocking part 913 of the protruding pin 912 to escape from the step part 924, and the protruding pins 912 are pulled out of the through holes 923 and, as a result, the eraser wheel 91 is escaped from the shell cover 92. While the eraser wheel 91 is escaped from the shell cover 92, the plurality of glue removing blocks 911 cannot be uniformly in contact with the place being removed glue, so the user must stop the glue-removing action and manually press the eraser wheel 91 to lock the blocking parts 913 in the step parts 924 again. At this time, as the glue-removing action of the eraser wheel 91 is stopped, the peripheral edge 914 held on the annular wall 922 is not back to its former position, the user must manually press the peripheral edge 914 back to its former position in the groove part 921, but the user's operation must be interrupted.

Please refer to FIG. 8 which shows other conventional eraser wheel 93. A main difference between the eraser wheel 93 and the eraser wheel 91 is that the eraser wheel 93 has a plurality of glue removing blocks 932 and 933 respectively formed on wide root parts 931 thereof, inside-outside staggered, and arranged in interval. Compared with the eraser wheel 91, the glue removing blocks 932 and 933 of the eraser wheel 93 have smaller areas in tight contact with the working surface during glue-removing operation, so the deformation of the peripheral edge 934 can be reduced to decrease the times of escapes of the eraser wheel 93 from the shell cover 92. However, the escape of the eraser wheel 93 from the shell cover 92 cannot be avoided completely, and reduced tight-contact areas between the working surface and the glue removing blocks 932 and 933 also cause a poor glue-removing effect

SUMMARY OF THE INVENTION

In order to solve aforesaid problems, a primary objective of the present disclosure is to provide an eraser wheel assembly structure to combine with a tool, the structure can prevent the eraser wheel from being escaped from the shell cover without reducing the glue-removing effect, so as to ensure the stable positioning effect between the eraser wheel and the shell cover during rotation for removing glue.

The eraser wheel assembly structure includes a shell cover, an eraser wheel body and a fastener.

The shell cover has a bottom board and a blocking wall annularly projected on a peripheral of the bottom board. The eraser wheel body is made from flexible material and configured to be driven by a driving head to rotate for removing glue. The eraser wheel body has a disc-shaped base with a peripheral edge which is continuous and unbroken. The disc-shaped base is attached with the bottom board by a first surface thereof facing the bottom board, and assembled inside the blocking wall, and has a second surface opposite to the first surface, and has a plurality of glue removing blocks which each is long-bar-shaped and curvy. The eraser wheel body has an axle hole located at a central part thereof and cut therethrough, and a pressing part disposed around the axle hole which has a plurality of positioning holes thereon. The bottom board has a plurality of positioning studs configured to insert into the positioning holes correspondingly, and the blocking wall is located at the outside of the peripheral edge of the disc-shaped base and faces the peripheral edge radially. A gap exists between the blocking wall and the peripheral edge to tolerate radial extension of the disc-shaped bas during operation. The plurality of glue removing blocks are located between the pressing part and the peripheral edge and in a spiral arrangement on the second surface, and a pitch between any two glue removing blocks adjacent to each other has a width gradually enlarged from a side thereof near the pressing part to the peripheral edge. The fastener is configured to fasten the eraser wheel with the driving head and has a plate with a width larger than that of the axle hole, and has a first connecting part at a side thereof. The driving head has a pivot holder having a second connecting part, and the first connecting part is configured to insert through the axle hole to connect and fasten with the second connecting part. The fastener has a step part located between the plate and the first connecting part and having a diameter ranged between diameters of the plate and the first connecting part, and the step part has a first press surface opposite to the plate. The pivot holder has a second press surface corresponding to the first press surface. When the first connecting part and the second connecting part are connected and fastened with each other, the two sides of the bottom board are sandwiched between the first press surface and the second press surface and the plate is abutted against the pressing part. The bottom board has a groove formed on the side thereof abutted against the second press surface, and a blocking part formed inside the groove, and a washer with a thick smaller than a depth of the groove is disposed in the groove and constrained by the blocking part. When the bottom board is sandwiched, the washer is abutted against the second press surface.

Preferably, the gap has a width ranged from 1 mm to 3 mm.

Preferably, the first connecting part is an outer thread part and the second connecting part is an inner thread part configured to screw and lock with the first connecting part.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
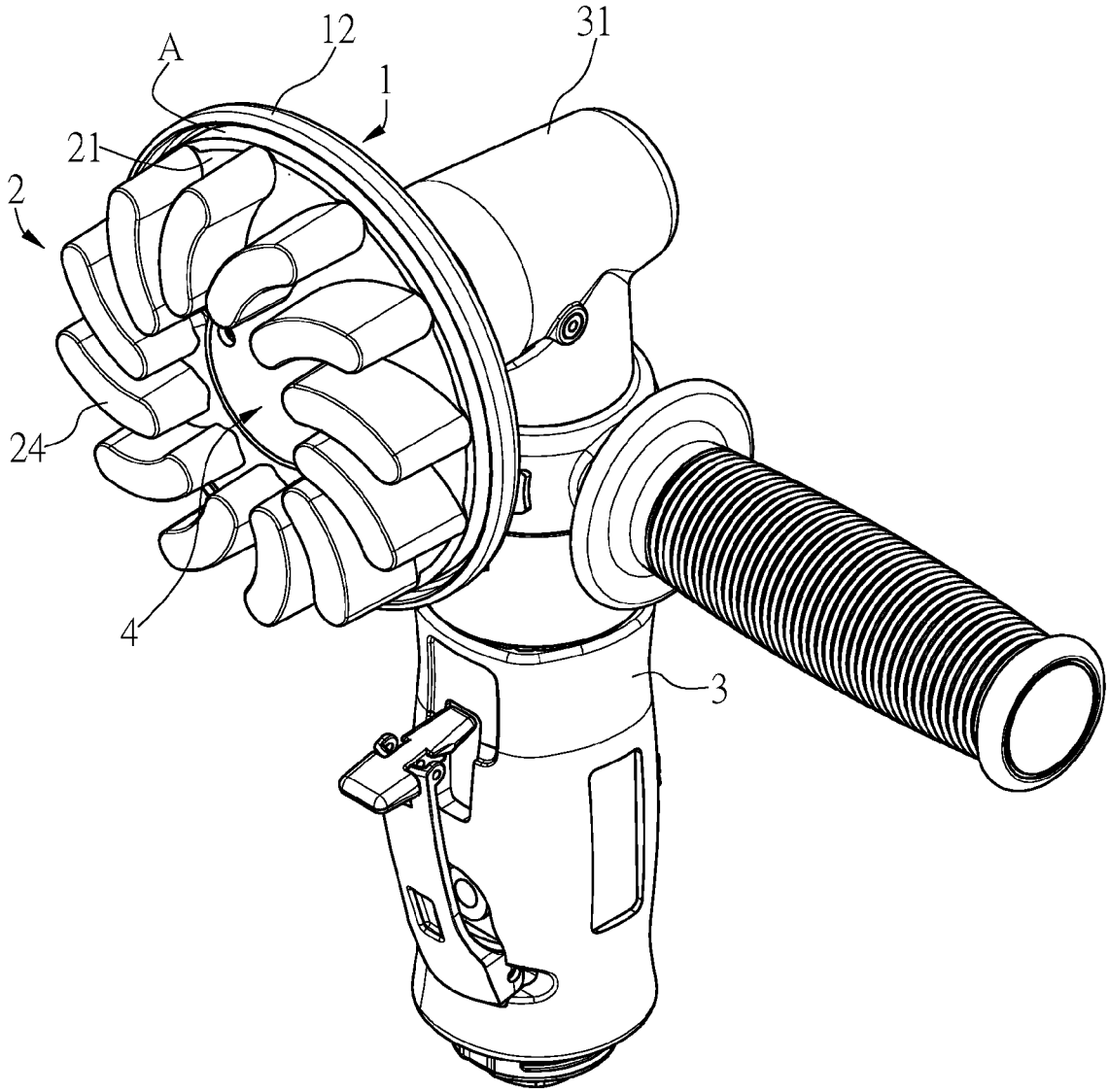
FIG. 1*a* perspective assembled view of an appearance of an embodiment of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Please refer to FIGS. 1 through 5 which show an embodiment of the present disclosure. The embodiment shown in FIGS. 1 through 5 is an exemplary structure for illustrative purpose, but the present disclosure is not limited thereto.

Figure 2:
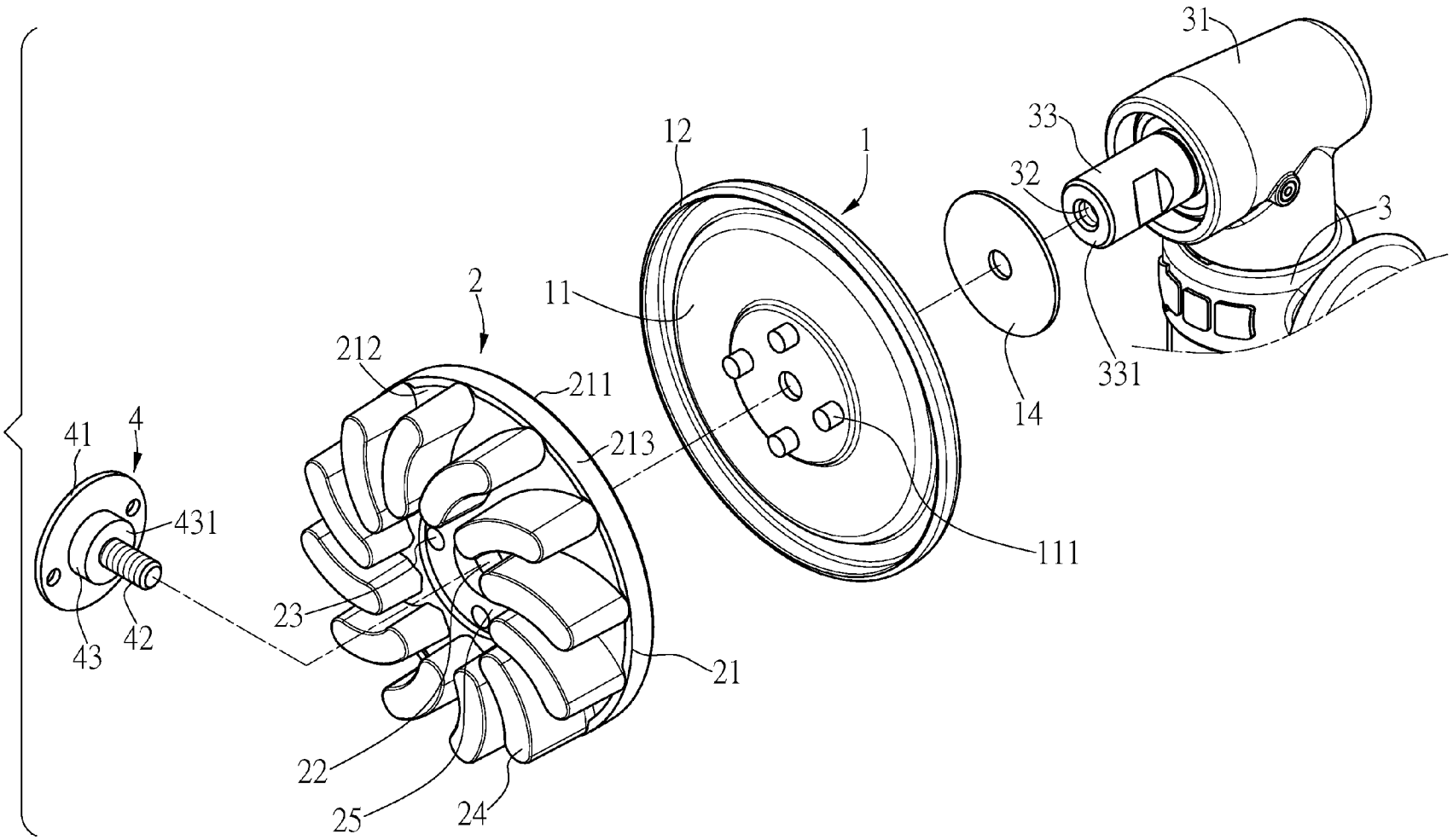
FIG. 2 is an exploded view of the embodiment of the present disclosure.

In present embodiment, an eraser wheel assembly structure to combine with a tool is provided. As shown in FIGS. 1 and 2, the eraser wheel assembly structure includes a shell cover 1 and an eraser wheel body 2, and can be mounted on a driving head 31 of a grinding tool 3.

As shown in FIG. 2, the shell cover 1 includes a bottom board 11 which has a blocking wall 12 formed at a peripheral thereof. The eraser wheel body 2 is made from flexible material and has a hardness falling within a score range of 50 to 60 in Shore hardness Type A. After assembled with the shell cover 1, the eraser wheel body 2 can be driven by the driving head 31 to rotate for removing glue. The eraser wheel body 2 includes a disc-shaped base 21 having a peripheral edge 211 which is continuous and unbroken. The disc-shaped base 21 is attached with the bottom board 11 by a first surface 211 thereof facing the bottom board 11, and assembled inside the blocking wall 12. The disc-shaped base 21 has a second surface 212 which is opposite to the first surface 211, and a plurality of glue removing blocks 24 are disposed on the second surface 212. The eraser wheel body 2 has an axle hole 22 located at a central part thereof and cut therethrough, and has a pressing part 25 disposed around the axle hole 22 and having a plurality of positioning hole 23 thereon.

Figure 3:
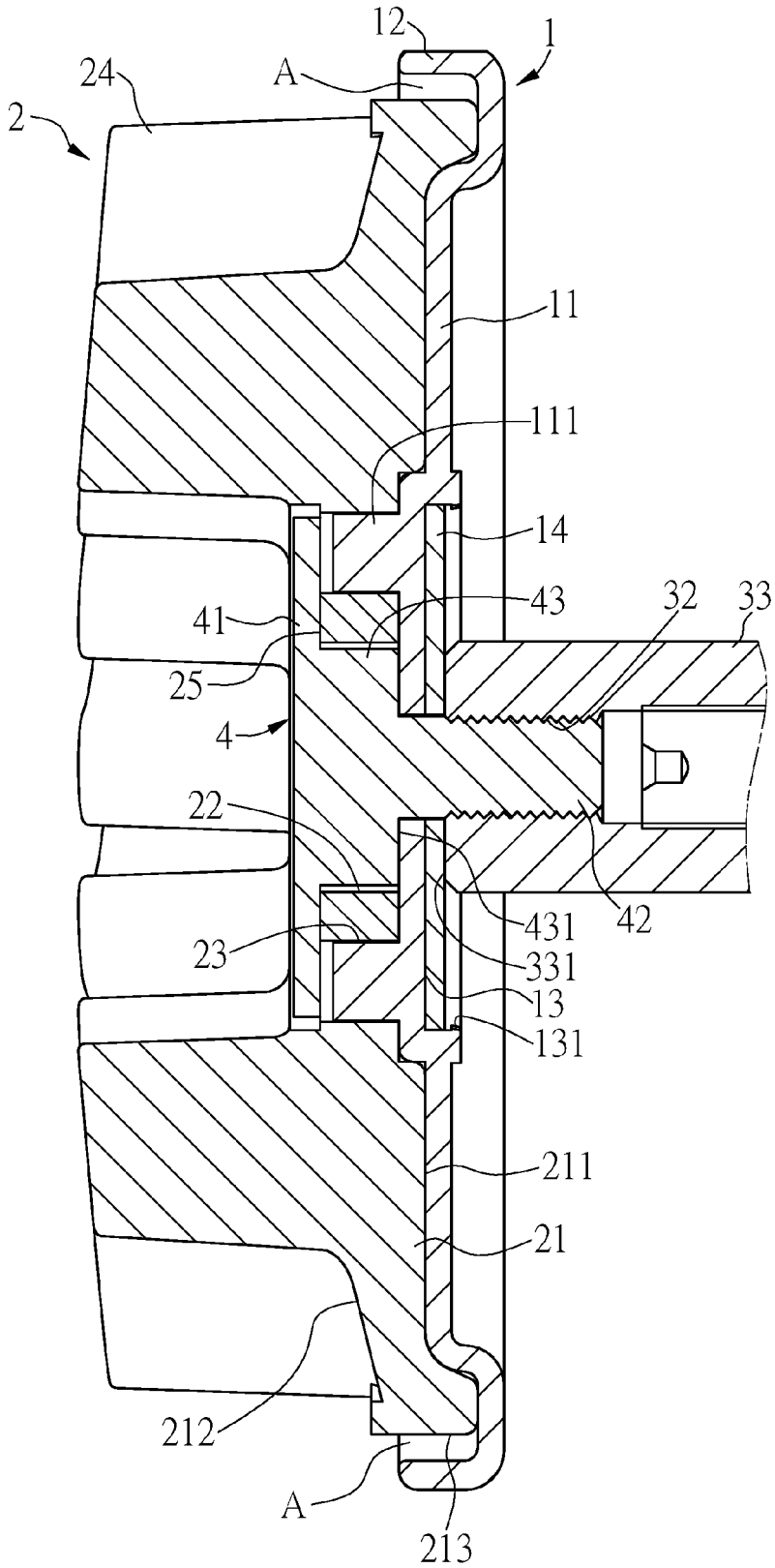
FIG. 3 is a cross-sectional view of an assembly of a shell cover and an eraser wheel body of the present disclosure.

As shown in FIGS. 1 through 3, the bottom board 11 has a plurality of positioning studs 111 which can be inserted into the positioning holes 23 correspondingly. The blocking wall 12 is located at the outside of the peripheral edge 211 of the disc-shaped base 21 and faces the peripheral edge 211 radially. A gap A exists between the blocking wall 12 and the peripheral edge 211 and has a width ranged from 1 mm to 3 mm preferably. In present embodiment, the width of the gap A is 2 mm, and the gap A tolerates the radial extension of the disc-shaped base 21 during operation.

Figure 4:
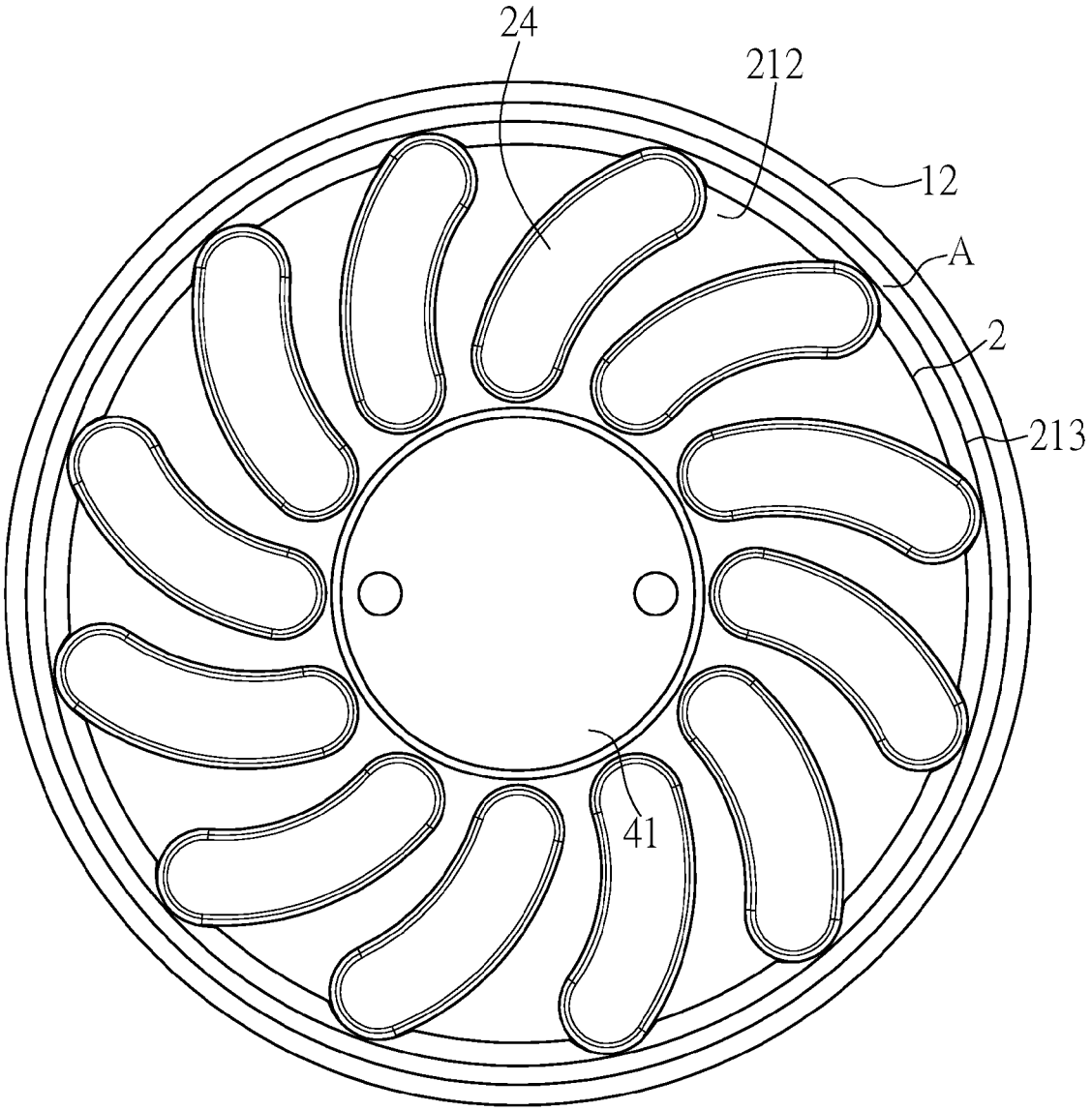
FIG. 4 is a plan view of glue removing blocks of the eraser wheel body of the present disclosure, illustrating that the glue removing blocks are in a spiral arrangement.

As shown in FIG. 4, each glue removing block 24 is long-bar-shaped and curvy, and the plurality of glue removing blocks 24 are located between the pressing part 25 and the peripheral edge 211 and in a spiral arrangement on the second surface 212, a pitch between any two glue removing blocks 24 adjacent to each other has a width gradually enlarged from a side thereof near the pressing part 25 to the peripheral edge 211.

As shown in FIGS. 2 and 3, the eraser wheel body 2 and the shell cover 1 are fastened with the driving head 31 by a fastener 4. The fastener 4 has a plate 41 which has a width larger than that of the axle hole 22 and used to press against the pressing part 25. The plate 41 has a first connecting part 42 at a side thereof, the driving head 31 has a second connecting part 32, and the first connecting part 42 can be inserted through the axle hole 22 to connect and fasten with the second connecting part 32.

The fastener 4 has a step part 43 located between the plate 41 and the first connecting part 42. The step part 43 has a diameter ranged between diameters of the plate 41 and the first connecting part 42, and has a first press surface 431 which is opposite to the plate 41. In present embodiment, the first connecting part 42 is an outer thread part and the second connecting part 32 is an inner thread part, so that the first connecting part 42 and the second connecting part 32 can be locked by a screwing manner.

As shown in FIGS. 2 and 3, the driving head 31 has a pivot holder 33 having the second connecting part 32 and a second press surface 331 corresponding to the first press surface 431. When the first connecting part 42 are connected and fastened with the second connecting part 32, the two sides of the bottom board 11 are sandwiched between the first press surface 431 and the second press surface 331. The bottom board 11 has a groove 13 formed on the side abutted against the second press surface 331, and a blocking part 131 formed inside the groove 13. A washer 14 with a thick smaller than a depth of the groove 13 is disposed in the groove 13 and constrained by the blocking part 131. When the bottom board 11 is sandwiched, the washer 14 is abutted against the second press surface 331.

Figure 5:
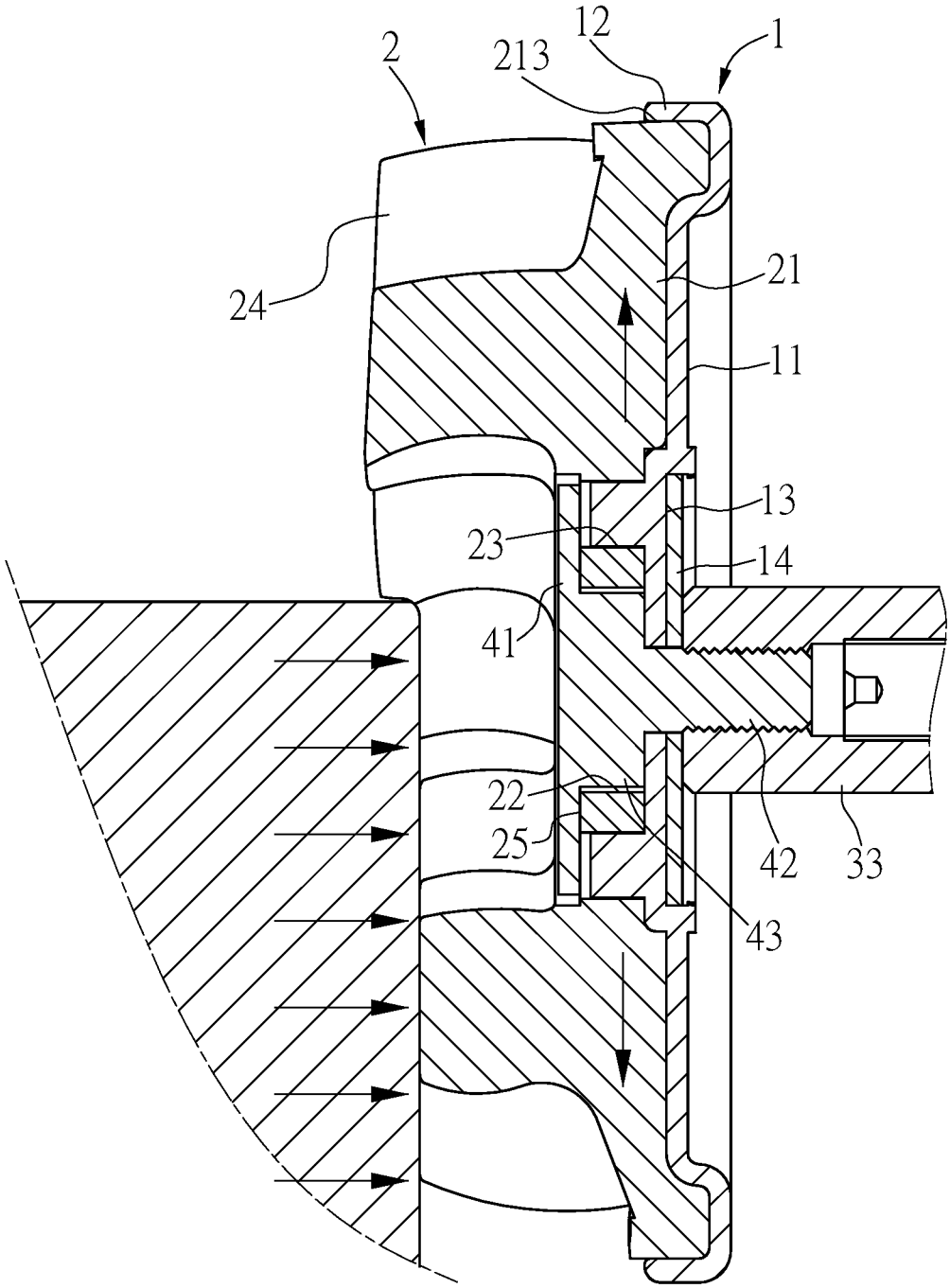
FIG. 5 is a schematic view of the eraser wheel body having axial deformation during glue-removing operation, illustrating that a gap exists between a blocking wall and a peripheral edge of a disc-shaped base to tolerate radial extension of the disc-shaped base, to enable the peripheral edge of the disc-shaped base to just fill the gap without departing from the blocking wall.
Figure 6:
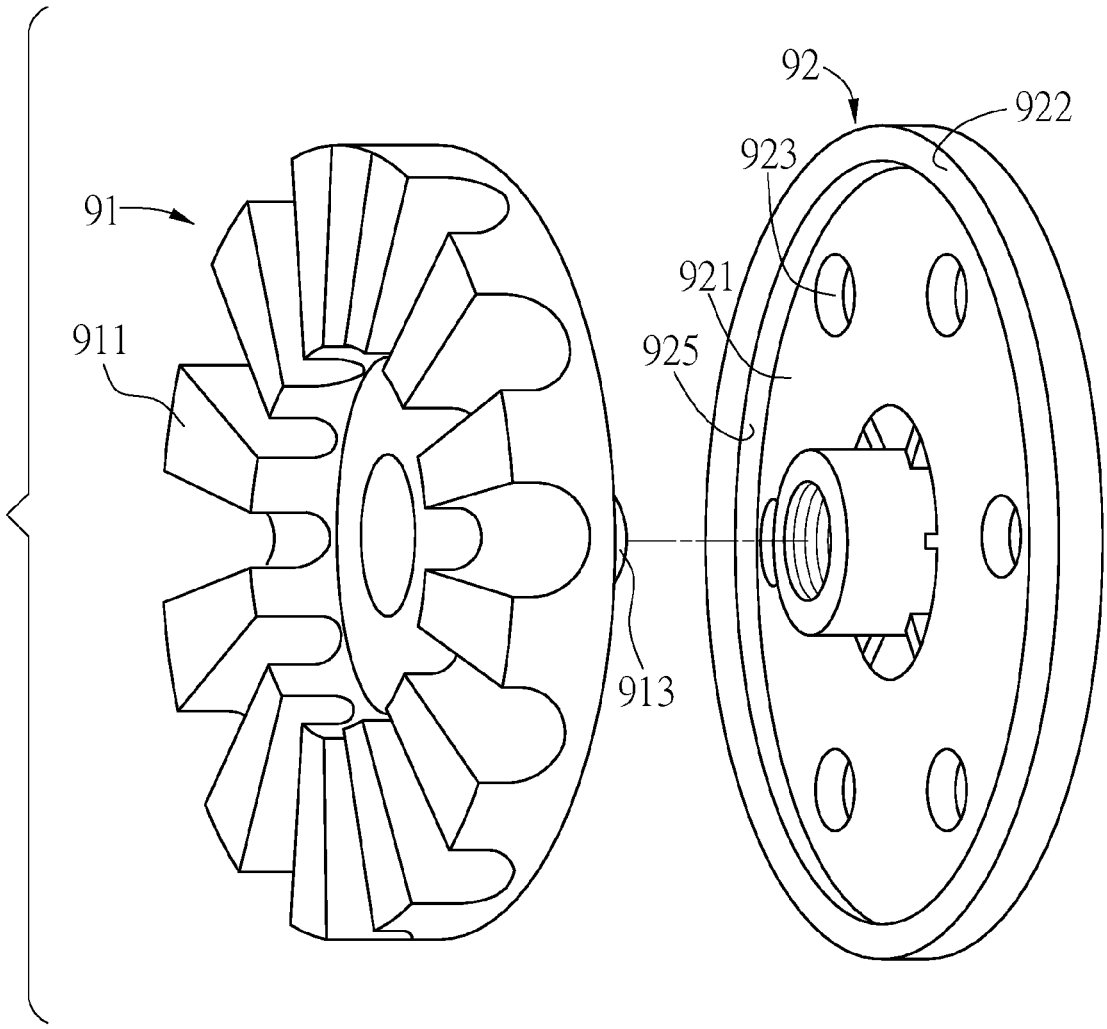
FIG. 6 PRIOR ART
FIG. 6 is a schematic assembly view of a conventional eraser wheel and a shell cover for fixing the eraser wheel.
Figure 7:
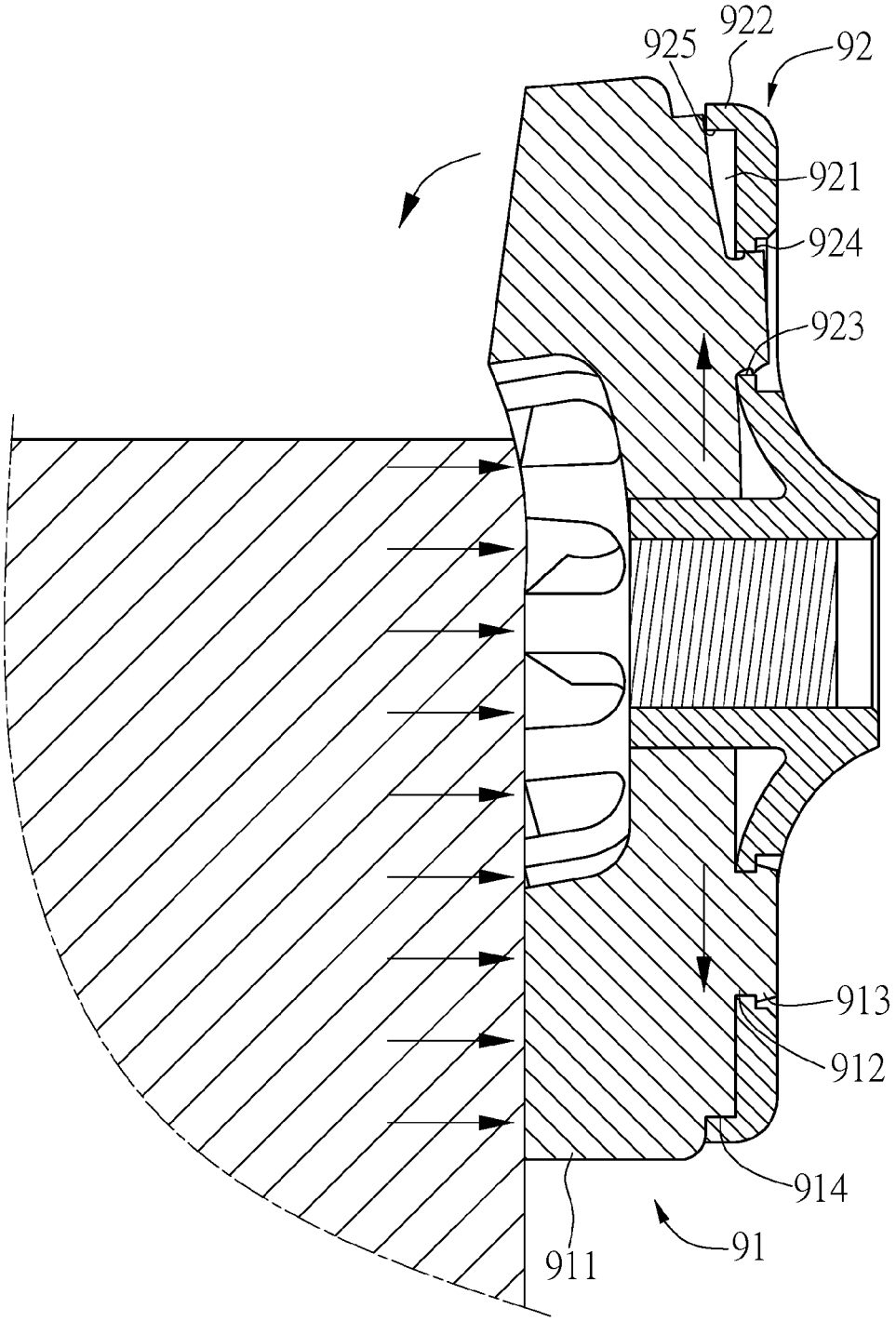
FIG. 7 PRIOR ART
FIG. 7 is a schematic view of a conventional eraser wheel having an axial deformation during glue-removing operation, illustrating that no gap exists between the peripheral edge of the eraser wheel and the blocking wall to tolerate the radial extension, so the peripheral edge may be escaped from the blocking wall.
Figure 8:
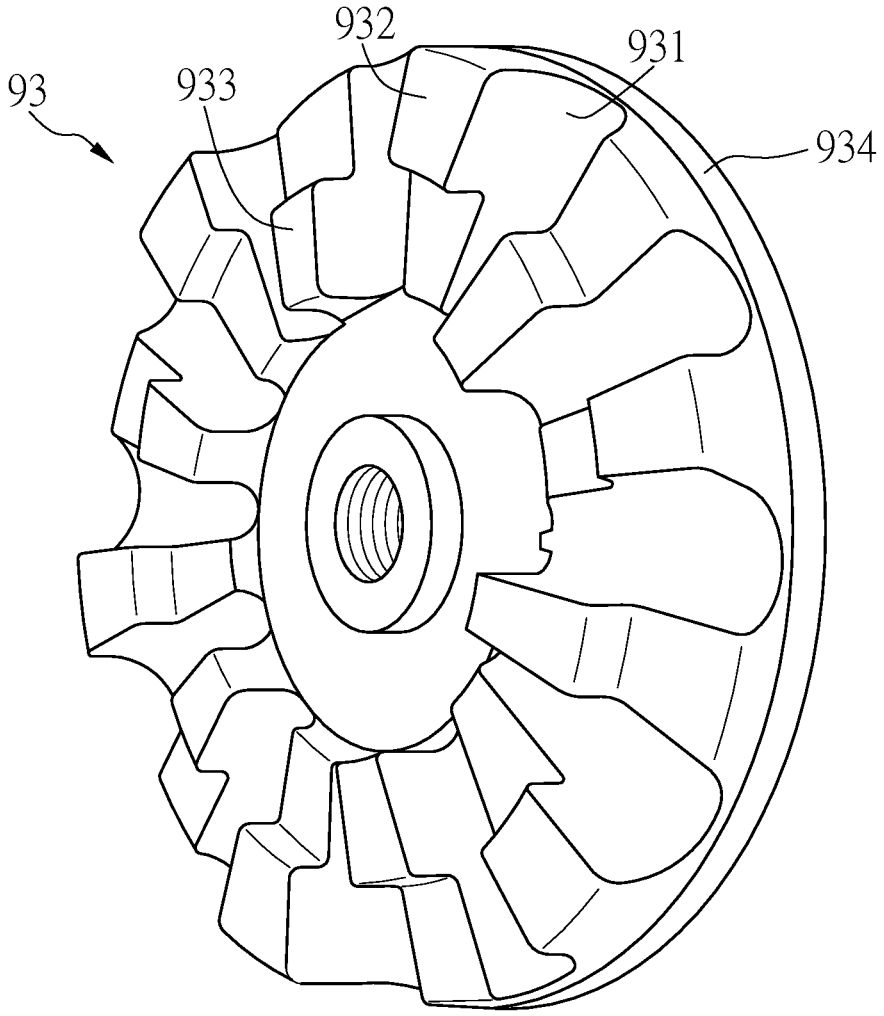
FIG. 8 PRIOR ART
FIG. 8 is an elevational view of other conventional eraser wheel.

In present embodiment, when the eraser wheel body 2 is driven by the driving head 31 to rotate for removing glue, if the disc-shaped base 21 is deformed to be flatter in an axial direction and wider in a radial direction subject to the pressure caused by the glue removing blocks 24 being tightly attached on the place being removed glue, the radial extension of the disc-shaped base 21 under the axial pressure (as shown in FIG. 5) is tolerable because of the gap A between the blocking wall 12 of the shell cover 1 and the peripheral edge 211 of the disc-shaped base 21, so that it can prevent the peripheral edge 211 of the disc-shaped base 21 from be escaped out of the blocking wall 12 while the peripheral edge 211 is radially blocked by the blocking wall 12. Therefore, the disc-shaped base 21 of the eraser wheel body 2 can be held inside the blocking wall 12 and avoided from be escaped axially during the glue-removing action. In addition, when the eraser wheel body 2 is driven by the driving head 31 to rotate in high-speed for removing glue, under aforesaid pressed condition, the flexible peripheral edge 211 of the disc-shaped base 21 is possibly escaped in a direction away from the bottom board 11. When the aforesaid pressed condition disappears, the peripheral edge 211 of the disc-shaped base 21 can be back to its former position inside the bottom board 11 without touching the blocking wall 12 because of the existence of the gap A, so that the present disclosure does not have the problem that the peripheral edge 211 fails to return to its former position because of blocking of the blocking wall 12.

According to above-mentioned description, obviously the present disclosure has following advantage. Compared with the assembly of the conventional eraser wheel and the shell cover, the present disclosure provides the gap A existing between the blocking wall 12 of the shell cover 1 and the peripheral edge 211 of the disc-shaped base 21, and the gap A is served as a tolerable space for the radial extension of the disc-shaped base 21 under the axial pressure, so as to completely solve the problem that the peripheral edge of the conventional eraser wheel is squeezed out of the annular wall while the eraser wheel is axially extended under the axial pressure. Therefore, unlike the conventional eraser wheel 93, the present disclosure can prevent the eraser wheel body 2 from being escaped from the shell cover 1 without the plurality of glue removing blocks 932 and 933 arranged in interval and disposed in the inside-outside staggered arrangement, and further ensure the stable positioning effect between the shell cover 1 and the eraser wheel body 2 during rotation for removing glue.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An eraser wheel assembly structure, fastened with a driving head of a grinding tool, the eraser wheel assembly structure comprising:

a shell cover having a bottom board and a blocking wall annularly formed on a peripheral of the bottom board;

an eraser wheel body made from flexible material and configured to be driven by the driving head to rotate for removing glue, the eraser wheel body having a disc-shaped base with a peripheral edge which is continuous and unbroken, wherein the disc-shaped base is attached with the bottom board by a first surface thereof facing the bottom board, and assembled inside the blocking wall, and has a second surface opposite to the first surface, and has a plurality of glue removing blocks which each is long-bar-shaped and curvy, and wherein the eraser wheel body has an axle hole located at a central part thereof and cut therethrough, and a pressing part disposed around the axle hole which has a plurality of positioning holes thereon, and wherein the bottom board has a plurality of positioning studs configured to insert into the positioning holes correspondingly, and the blocking wall is located at the outside of the peripheral edge of the disc-shaped base and faces the peripheral edge radially, and wherein a gap exists between the blocking wall and the peripheral edge to tolerate radial extension of the disc-shaped bas during operation; wherein the plurality of glue removing blocks are located between the pressing part and the peripheral edge and in a spiral arrangement on the second surface, and a pitch between any two glue removing blocks adjacent to each other has a width gradually enlarged from a side thereof near the pressing part to the peripheral edge;

a fastener configured to fasten the eraser wheel with the driving head and having a plate with a width larger than that of the axle hole, and having a first connecting part at a side thereof, wherein the driving head has a pivot holder having a second connecting part, and the first connecting part is configured to insert through the axle hole to connect and fasten with the second connecting part; the fastener has a step part located between the plate and the first connecting part and having a diameter ranged between diameters of the plate and the first connecting part, and the step part has a first press surface opposite to the plate, the pivot holder has a second press surface corresponding to the first press surface, and when the first connecting part and the second connecting part are connected and fastened with each other, the two sides of the bottom board are sandwiched between the first press surface and the second press surface and the plate is abutted against the pressing part; wherein the bottom board has a groove formed on the side thereof abutted against the second press surface, and a blocking part formed inside the groove, and a washer with a thick smaller than a depth of the groove is disposed in the groove and constrained by the blocking part, and when the bottom board is sandwiched, the washer is abutted against the second press surface.

2. The eraser wheel assembly structure according to claim 1, wherein the gap has a width ranged from 1 mm to 3 mm.

3. The eraser wheel assembly structure according to claim 1, wherein the first connecting part is an outer thread part and the second connecting part is an inner thread part configured to screw and lock with the first connecting part.

* * * * *